US005443656A

United States Patent [19]

Burrows et al.

[11] Patent Number: 5,443,656

[45] Date of Patent: Aug. 22, 1995

[54] CELLULASE, SODIUM BICARBONATE AND CITRIC ACID CLEANING SOLUTION AND METHODS OF USE

[75] Inventors: Mary R. Burrows, Pinckney; Märtha K. Johansson, Ann Arbor, both of Mich.

[73] Assignee: Thetford Coporation, Ann Arbor, Mich.

[21] Appl. No.: 100,547

[22] Filed: Jul. 30, 1993

[51] Int. Cl.[6] ..... B08B 9/08; C11D 3/386

[52] U.S. Cl. ..... 134/42; 252/174.12; 252/126.12; 252/174.14; 210/606; 210/612; 210/632

[58] Field of Search ..... 252/174.12, DIG. 12, 252/174.14, 442; 134/42; 210/606, 632

[56] References Cited

U.S. PATENT DOCUMENTS

| | | | |
|---|---|---|---|
| 3,506,582 | 4/1970 | Gertzman et al. | 252/157 |
| 3,635,797 | 1/1972 | Battistoni et al. | 195/56 |
| 3,983,002 | 9/1976 | Ohya et al. | 195/66 R |
| 4,522,738 | 6/1985 | Magid et al. | 252/90 |
| 4,540,506 | 9/1985 | Jacobson et al. | 252/174.12 |
| 4,610,860 | 9/1986 | Durham et al. | 252/174.12 |
| 4,911,843 | 3/1990 | Hunniford et al. | 210/610 |
| 5,264,146 | 11/1993 | Tobiason et al. | 252/157 |

FOREIGN PATENT DOCUMENTS

| | | |
|---|---|---|
| 0178731 | 4/1986 | European Pat. Off. . |
| 0271004 | 6/1988 | European Pat. Off. . |
| 0495257 | 7/1992 | European Pat. Off. . |

*Primary Examiner*—Paul Lieberman
*Assistant Examiner*—Kery A. Fries
*Attorney, Agent, or Firm*—Harness, Dickey & Pierce

[57] ABSTRACT

A composition and process for the degradation of fibrous materials is provided. More particularly, a composition comprising cellulase, sodium bicarbonate and citric acid, wherein the combination of sodium bicarbonate and citric acid unexpectedly increases the cellulase activity and thus improves the breakdown of toilet tissue in waste holding tanks, is set forth. The composition of the present invention may also include other additives known to those skilled in the art.

2 Claims, No Drawings

CELLULASE, SODIUM BICARBONATE AND CITRIC ACID CLEANING SOLUTION AND METHODS OF USE

FIELD OF THE INVENTION

The present invention relates to a composition and process for the degradation of fibrous materials. More particularly, the present invention relates to a composition comprising cellulase, sodium bicarbonate and citric acid which improves the breakdown of toilet tissue in a waste system.

BACKGROUND OF THE INVENTION

Fibrous materials including toilet tissue and other paper products often adhere to the walls of waste holding tanks, clogging the opening used for draining the tanks. The fibrous materials may also adhere to probes which measure the level of waste in the holding tank rendering the probes ineffective.

The use of enzymes to improve degradation of fibrous materials in waste holding tanks is well known. One such enzyme, cellulase, hydrolyzes cellulosic fiber such as that found in toilet tissue, to form glucose. It is also known that to improve cellulase activity, thereby increasing degradation of the fibrous materials, an acid may be added to the holding tank.

While enzymes such as cellulase and cellulase in combination with acid improve toilet tissue degradation, there remains a need for an improved composition and process for fibrous material degradation. There also remains a need for a composition which enhances cellulase activity. There further remains a need for an improved, cost-effective composition and process for fibrous material degradation.

SUMMARY OF THE INVENTION

The composition and process of the present invention improves the degradation of fibrous materials, in particular, in waste holding tanks. The composition of the present invention comprises cellulase, sodium bicarbonate and citric acid. It has been found that the combination of sodium bicarbonate and citric acid unexpectedly improves cellulase activity. The addition of sodium bicarbonate and citric acid in a composition including cellulase thus allows for a lower concentration of cellulase to be used in the composition. Other additives including drying agents, surfactants, deodorizers, dyes and fillers may also be added to the composition.

The composition of the present invention is added to fibrous materials present in waste holding tanks. The composition hydrolyzes the cellulosic fiber, thereby increasing fibrous material degradation. The process of the present invention thus comprises the addition of the composition of the present invention to a waste holding tank.

Additional objects, advantages, and features of the present invention will become apparent from the following description and appended claims.

DETAILED DESCRIPTION OF THE INVENTION

The composition of the present invention comprises cellulase, sodium bicarbonate and citric acid. The cellulase used in the composition may be obtained through various sources including Solvay Enzymes. The cellulase of the present invention has an effective pH in the range of from about 3 to about 7, with an optimized range of from about 4 to about 5. The effective temperature range of the cellulase is from about 20° to about 50° C., with an optimized temperature range of from about 40° to about 50° C. The concentration of cellulase used in the composition of the present invention is from about 0.01 gms/L to about 1 gms/L. The preferred concentration of cellulase is from about 0.01 gms/L to about 0.05 gms/L. The most preferred concentration of cellulase is from about 0.01 gms/L to about 0.03 gms/L.

The sodium bicarbonate used in the present invention may also be obtained through various sources including Church & Dwight. The concentration of sodium bicarbonate used in the composition of the present invention is from about 0.02 gms/L to about 0.4 gms/L. The preferred concentration of sodium bicarbonate is from about 0.02 gms/L to about 0.3 gms/L. The most preferred concentration of sodium bicarbonate is from about 0.04 gms/L to about 0.1 gms/L.

The citric acid used in the present invention is also available through various sources including Pfitzer. The preferred citric acid of the present invention is a 100% active, granular product. The concentration of the citric acid used in the composition is from about 0.02 gms/L to about 0.4 gms/L. The preferred concentration of citric acid is from about 0.02 gms/L to about 0.3 gms/L. The most preferred concentration of citric acid is from about 0.06 gms/L to about 0.2 gms/L.

Other additives such as surfactants, drying agents, fillers, dyes and deodorizers may also be added to the composition of the present invention. Examples of suitable surfactants include sodium lauryl sulfate, ethoxylated alcohol and eo/po block copolymers. Examples of suitable drying agents include silicon dioxide and sodium aluminosilicate. Examples of suitable fillers are salts such as sodium chloride, calcium chloride and potassium chloride. It will be appreciated to those skilled in the art that in accordance with the principles of the present invention, the concentration of the additives may be varied depending on the desired result of the composition.

An example of a preferred composition of the present invention is set forth in Table 1.

TABLE 1

| COMPONENT | % WEIGHT OF TOTAL COMPOSITION |
|---|---|
| Sodium Chloride | 77.1 |
| Citric Acid | 9.36 |
| Sodium Bicarbonate | 6.24 |
| Silicon Dioxide | 3.25 |
| Cellulase | 2.16 |
| Surfactant (ethoxylated alcohol) | 1.52 |
| Surfactant (sodium lauryl sulfate) | 0.4 |
| Blue Dye | 0.006 |

A preferred composition may also include the above components with the ethoxylated alcohol increased by 0.4% and the sodium chloride reduced by 0.4%.

As described above, the addition of sodium bicarbonate and citric acid unexpectedly enhances cellulase activity. It will therefore be understood to those skilled in the art that in accordance with the principles of the present invention, the concentration ranges set forth herein are merely exemplary and the concentration of cellulase, sodium bicarbonate and citric acid, as well as the concentration of any other additives employed may be varied to achieve the desired result.

The process of the present invention includes the addition of the composition of the present invention to fibrous materials, in particular, in waste holding tanks. The cellulosic fiber present is hydrolyzed, thereby degrading the fibrous material. This process decreases the clogging which often occurs in the drainage area of holding tanks as well as alleviating the adherence of fibrous material to the probes which measure the level of waste, often found in holding tanks.

SPECIFIC EXAMPLE 1

The composition of the present invention may be produced by blending cellulase and sodium bicarbonate, as well as citric acid and any other additives such as surfactants, fillers, dyes and deodorizers. In one embodiment of the present invention, about 77.1% (percentages herein refer to percent weight of total composition) salt (as a filler), such as sodium chloride, about 1.52% surfactant, such as ethoxylated alcohol and about 2.16% cellulase is added to a V-blender. The blender is run for approximately five minutes with the intensifier bar off so as not to crush the salt. The V-blender tumbles and therefore mixes and evenly coats the salt particles. About 3.25% drying agent, such as silicon dioxide, is then added. The V-blender is again run for approximately five minutes. Finally, about 6.24% sodium bicarbonate, about 9.36% citric acid and about 0.4% surfactant, such as sodium lauryl sulfate are added. The V-blender is again run for approximately seven minutes.

SPECIFIC EXAMPLE 2

The following is a description of an experiment performed to test the efficacy of various solutions including water, cellulase (at various concentrations), cellulase in combination with citric acid, cellulase in combination with sodium bicarbonate, and cellulase in combination with citric acid and sodium bicarbonate, in disintegrating fibrous material.

A piece of Aqua-Soft toilet tissue (Thetford Corporation, Ann Arbor, Mich.) was allowed to soak in the various solutions set forth in Table 2 for 24 hours, with gentle stirring with a stirring rod. After the 24 hour period, a digestion grade was assigned from 0–6, 6 being broken down to fibers. The results of the experiment are set forth in Table 2.

TABLE 2

| SUBSTANCE | DISINTEGRATION GRADE, 24 HOURS |
|---|---|
| Water | 2 |
| Cellulase (0.03 gms/L) | 3, 4* |
| Cellulase (0.023 gms/L) | 3 |
| Cellulase (0.015 gms/L) | 3 |
| Cellulase (0.03 gms/L) + Citric Acid (0.28 gms/L) | 3.5, 4* |
| Cellulase (0.03 gms/L) + Sodium Bicarbonate (0.27 gms/L) | 3.5 |
| Cellulase (0.014 gms/L) + Citric Acid (0.06 gms/L) + Sodium Bicarbonate (0.04 gms/L) | 4.5 |
| Cellulase (0.03 gms/L) + Citric Acid (0.28 gms/L) + Sodium Bicarbonate (0.27 gms/L) | 5.5, 6* |
| Tissue Digester (cellulase 0.03 gms/L) | 3.5 |

*Where two grades are listed, the results of two different tests are reported.

Tissue Digester is available from the Thetford Corporation, Ann Arbor, MI, and contains, along with cellulase, sodium chloride, silicon dioxide, propylene glycol and blue dye.

As can be seen from Table 2, the addition of citric acid and sodium bicarbonate allowed a lower amount of cellulase with increased tissue disintegration. The reduction in the concentration of cellulase required for tissue degradation provides substantial cost savings.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the specification and following claims.

We claim:

1. A process for increasing fibrous material degradation of toilet tissue and other cellulose products comprising:

a) providing a composition comprising from about 0.01 gm/L to about 1 gm/L cellulase, from about 0.02 gm/L to about 0.4 gm/L sodium bicarbonate and from about 0.02 gm/L to about 0.4 gm/L citric acid; and b) adding the composition of a) to the fibrous material.

2. A process for increasing fibrous material degradation in a waste holding tank comprising:

a) providing a composition comprising from about 0.01 gms/L to about 0.03 gms/L cellulase, from about 0.04 gms/L to about 0.1 gms/L sodium bicarbonate and from about 0.06 gms/L to about 0.2 gms/L citric acid; and b) adding the composition of step a) to the waste holding tank.

* * * * *